US007559218B2

(12) United States Patent
Soudan, Jr.

(10) Patent No.: US 7,559,218 B2
(45) Date of Patent: Jul. 14, 2009

(54) ITEM SECURING APPARATUS AND METHOD FOR SECURING ITEMS TO A GROUND SURFACE

(76) Inventor: Robert A. Soudan, Jr., 120 Glenwood Ave., Winnetka, IL (US) 60093

( * ) Notice: Subject to any disclaimer, the term of this patent is extended or adjusted under 35 U.S.C. 154(b) by 359 days.

(21) Appl. No.: 11/423,014

(22) Filed: Jun. 8, 2006

(65) Prior Publication Data

US 2007/0283732 A1 Dec. 13, 2007

(51) Int. Cl.
*B65D 55/14* (2006.01)

(52) U.S. Cl. ..... 70/63; 109/45; 109/50; 248/530; 248/551; 70/14; 70/58

(58) Field of Classification Search ..... 70/58, 70/63, 14, 18, 19; 248/530, 551–553; 109/45, 109/50–52

See application file for complete search history.

(56) References Cited

U.S. PATENT DOCUMENTS 1,222,739 A * 4/1917 De Chime ..... 248/158
1,959,291 A * 5/1934 Millice ..... 109/51
2,315,158 A * 3/1943 Markham ..... 312/100
3,067,846 A * 12/1962 Luebkeman ..... 52/157
3,710,736 A * 1/1973 Biondi et al. ..... 109/50
3,797,283 A * 3/1974 Honer ..... 70/58
3,812,279 A * 5/1974 Voegeli ..... 174/38
3,990,279 A * 11/1976 Brickel ..... 70/233
4,118,902 A * 10/1978 Saxton ..... 52/27
4,436,214 A 3/1984 Henderson
4,444,031 A * 4/1984 Watson ..... 70/232
4,454,824 A 6/1984 Wood
4,457,240 A * 7/1984 Hungerford ..... 109/45
4,664,041 A 5/1987 Wood
4,907,522 A * 3/1990 Lutzke ..... 114/230.28
D315,711 S * 3/1991 Billings ..... D12/215
5,199,361 A 4/1993 Robinson
5,235,920 A * 8/1993 Hector ..... 109/51
5,240,353 A * 8/1993 Bower et al. ..... 405/259.1
5,501,086 A * 3/1996 Sherlock ..... 70/58
5,740,684 A 4/1998 Sherlock et al.
5,813,259 A * 9/1998 Martin ..... 70/234
5,855,129 A * 1/1999 Warren et al. ..... 70/234
6,082,157 A 7/2000 Boyce
6,082,697 A * 7/2000 Grunfeld ..... 248/508
6,113,268 A * 9/2000 Thompson ..... 383/40
6,971,209 B1 * 12/2005 Blevins ..... 52/157
7,246,783 B2 * 7/2007 Harold et al. ..... 248/545
D567,878 S * 4/2008 Tollis et al. ..... D20/41
7,409,915 B2 * 8/2008 Hagar ..... 109/50

* cited by examiner

*Primary Examiner*—Suzanne D Barrett
(74) *Attorney, Agent, or Firm*—K&L Gates, LLP

(57) ABSTRACT

An item securing apparatus and method for securing at least one item in a ground surface at a beach or other location is provided. The item securing apparatus includes a ground engaging member that is insertable into the ground surface and a locking housing that removably attaches to the ground engaging member. The locking housing is secured to the ground engaging member with one or more locking devices. An item securing mechanism attaches the item to the ground engaging member which secures the item to the ground surface.

29 Claims, 9 Drawing Sheets

ITEM SECURING APPARATUS AND METHOD FOR SECURING ITEMS TO A GROUND SURFACE

BACKGROUND

A beachgoer or a commercial entity, such as a hotel or other business, has limited options for securing items on a ground surface at a beach or other outside locations. Such items include bags, coolers, sandals, bicycles, barbeques, surfboards, chairs, boats, pets, wallets and any other valuable, article, belonging or accessory that one would transport to and desire to secure at a beach or other outside location. In one example, such items are generally locked in a vehicle in a parking lot or guarded by at least one person on the beach. In another example, a surfer or swimmer hides such items on the beach while surfing or swimming in the water. In a further example, hotels or other businesses undertake the cumbersome process of placing items, such as chairs, on the beach during business hours and removing those items from the beach after business hours or gathering and securing those items together at the beach after business hours.

Certain security devices for securing items on a beach have been proposed. Examples of these devices are found in U.S. Pat. Nos. 4,436,214, 4,454,824, 4,664,041, 5,199,361, 5,740,684 and 6,082,157. Generally, such devices employ a fixed-sized security compartment supported by an anchor that is engaged with the ground surface. A typical beachgoer secures items in the anchored security compartment in an attempt to protect the items while engaging in beach activities. Typically, such devices include a multiplicity of components making transport of these devices cumbersome. Additionally, such devices generally only protect those items stored in the anchored security compartment which limits the size and amount of items that a beachgoer or commercial entity can protect while at the beach.

While these devices each provide a particular function, none addresses a broad capability to secure a plurality of different items ranging in size with a compact device that is easily transported. There is thus a need to provide new and different security devices as well as new and different ways to secure items at a beach or other outside location.

SUMMARY

In view of the foregoing prior art shortcomings, the disclosed item securing apparatus and method, provides added utility, flexibility, and ergonomics that improve practicality for a person such as a beachgoer or a commercial entity. The item securing apparatus disclosed herein is strong, portable and easily assembled and disassembled.

The item securing apparatus of one embodiment is operative to secure an item to a ground surface, such as a beach or other surface at an outside location. Such items include bags, coolers, sandals, bicycles, barbeques, surfboards, chairs, boats, pets, wallets and any other valuable, article, belonging or accessory that one would transport to and desire to secure at a beach or other outside location.

The item securing apparatus generally includes a ground engaging member, a locking housing and an item securing mechanism. The ground engaging member is configured to be removably inserted into the ground surface by a person. Once inserted into the ground surface, the ground engaging member remains inserted until removed by a person. The ground engaging member is configured to removably receive and securely hold the item securing mechanism. The item securing mechanism is configured to attach to an item and to operatively secure the item to the ground engaging member. The locking housing is configured to be removably attached to and securely locked to the ground engaging member. Once attached and securely locked to the ground engaging member, the locking housing prevents the item securing member from disengaging or being removed from the ground engaging member and thus operatively secures the item to the ground surface. The locking housing also prevents the item securing member from being removed from the ground surface. The item remains operatively secured until a person unlocks and removes the locking housing from the ground engaging member.

Thus, in one embodiment, the item securing apparatus includes at least one locking device. The locking device is configured to secure the locking housing to the ground engaging member. The locking device is positioned in the locking housing and is movable between a locked position and an unlocked position. In the locked position, the locking device operatively secures and locks the locking housing to the ground engaging member. In the unlocked position, the locking device operatively releases the locking housing from the ground engaging member and allows removal of the locking housing from the ground engaging member. The locking device may be any suitable locking device such as a keyed lock, a rotation combination lock, an electronic lock, or a mechanical digital lock. In an alternative embodiment, the item securing apparatus includes a plurality of locking devices to operatively secure the locking housing to the ground engaging member. The plurality of locking devices may be the same or different locking devices in embodiments disclosed herein.

In one embodiment, the item securing member includes a securing element, such as a cable or chain, or a securing receptacle, such as a bag or container. The item securing mechanism has a first end configured to engage the body portion of the ground engaging member and has a second end configured to engage the item. In this manner, the item securing mechanism attaches the item to the ground engaging member.

In one embodiment, the locking housing includes a body portion and a handle portion. In one embodiment, the body portion has a conical configuration which deters removal of the locking housing from the ground engaging member. In one embodiment, the body portion includes a plurality of protrusions to increase theft deterrence. The protrusions are positioned along the annular lower periphery of the body portion. In one embodiment, the handle portion is integral with the body portion and extends from the lower end body portion in one embodiment. In another embodiment, the body portion includes a motion detector configured to detect tampering or motion of the locking housing. The motion detector increases theft deterrence by outputting audio signals, such as an alarm sound, or visual signals, such as flashing lights, if tampering or movement of the locking housing is detected.

In one embodiment, the ground engaging member includes an elongated body. The body has an opening extending through one end and a ground penetrating structure attached at the other end. In one embodiment, the body is formed from a tubular sleeve configured to receive the handle portion of the locking housing through the opening in the body. The ground penetrating structure retains the ground engaging member in the ground surface until a person removes the ground engaging member.

After the handle portion of the locking housing is inserted into the opening, the handle portion is configured to act as a turning or torque lever for the ground penetrating structure. For example, rotation of the handle portion causes the ground penetrating structure to rotate and this rotational force causes the ground penetrating structure to penetrate the ground surface. The handle portion is rotated until the ground penetrating structure penetrates the ground surface at an appropriate depth such as where only a small portion of the ground engaging member is above the ground surface.

After the ground engaging member is inserted into the ground, the handle portion is removed from the opening. The item securing mechanism, which is configured to be attached to the item, is positioned on or otherwise suitably attached to the handle portion or to the body of the ground engaging member. In an alternative embodiment, a plurality of item securing mechanisms are positioned on or otherwise suitably attached to the handle portion or the ground engaging member.

After placement of any item securing mechanisms, the handle portion of the locking housing is inserted into the ground engaging member. The ground engaging member is configured to telescopically receive the handle portion along its axis so that the handle portion is substantially sheathed inside the ground engaging member. Once the handle portion is fully inserted into the ground engaging member, the locking device locks the handle portion into engagement with the ground engaging member. Such engagement prevents extraction of the handle portion and entire locking housing from the ground engaging member until a person unlocks the locking device. Any items attached to the item securing mechanisms are operatively secured to the ground surface and remain operatively secured until a person removes the locking housing from the ground engaging member.

In one embodiment, the opening in the ground engaging member through which the handle portion extends to act as the turning or torque lever is blocked when the handle portion is sheathed inside the ground engaging member. This increases theft deterrence by preventing an alternate lever from being employed to disengage the ground engaging member from the ground surface.

In one embodiment, the handle portion is configured to freely rotate relative to or within the ground engaging member when sheathed inside the ground engaging member. This free rotation helps increase theft deterrence by preventing rotation of the ground engaging member when the locking housing is rotated.

In one embodiment, the locking device is integrated into the body portion of the locking housing and includes a locking member and a lock mechanism. In this embodiment, the lock mechanism includes a lock release member in the form of a lock release button and a lock activator member. If the locking device is set to the correct combination, the release button is configured to be depressed which will, in turn, move the lock activator member into an unlocked position. In the unlocked position, the locking housing is configured to be inserted into or removed from the ground engaging member. In one embodiment, the ground engaging member includes a biasing member, such as a spring, that aids in the removal of the handle portion from the ground engaging member. Once the locking device is unlocked, the item(s) are no longer secure. After removal of the handle portion of the locking housing from the ground engaging member, the handle portion is enabled to be employed as a turning or torque lever for the ground penetrating structure as described above.

Embodiments of the item securing apparatus provide an effective theft deterrent for all but the most diligent professional thief and will allow a person such as a beachgoer or a commercial entity, peace of mind when momentarily away from their items, valuables, articles, belongings or accessories.

Additional features and advantages are described herein, and will be apparent from, the following Detailed Description and the figures. A detailed description of embodiments of the invention will be made with reference to the accompanying drawings, wherein like numerals designate corresponding parts in the figures.

DETAILED DESCRIPTION

Figure 1:
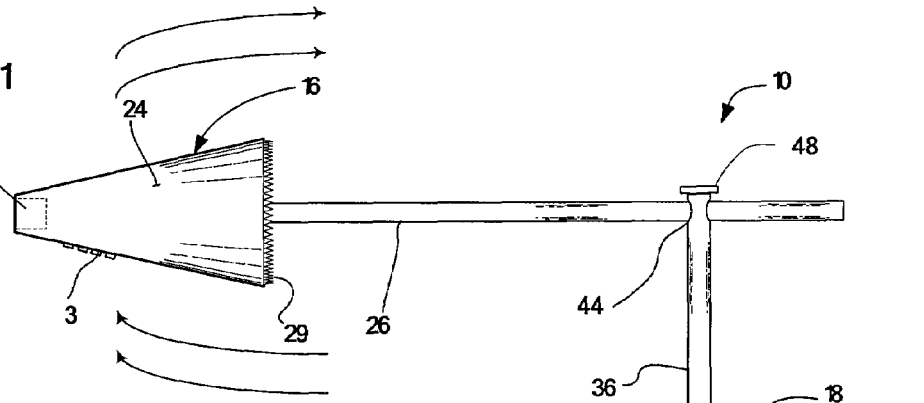
FIG. 1 is a side view of one embodiment of an item securing apparatus in a first operating position.
Figure 2:
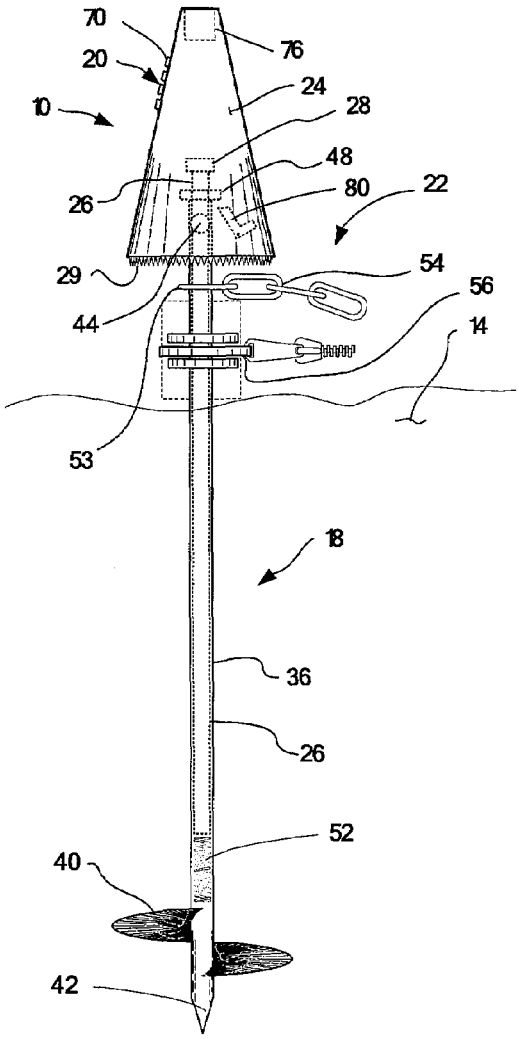
FIG. 2 is a side view of one embodiment of an item securing apparatus in a second operating position.
Figure 2:
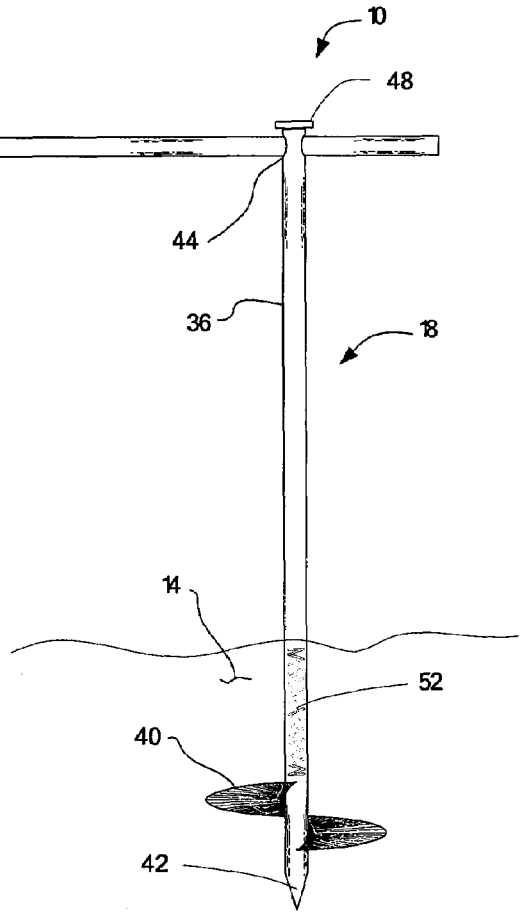

FIGS. 1 and 2 show one embodiment of an item securing apparatus 10 operative to secure at least one item 12 to a ground surface 14 at a beach or other location. The device 10 includes a locking housing 16 and a ground engaging member 18. At least one locking device 20 is positioned in the locking housing 16. Each locking device 20 is movable between a locked position and an unlocked position to removably attach and lock the locking housing 16 to the ground engaging member 18. At least one item securing mechanism 22 is engageable with or attachable to the ground engaging member 18 to operatively secure the at least one item 12 to the ground engaging member 18.

Figure 3:
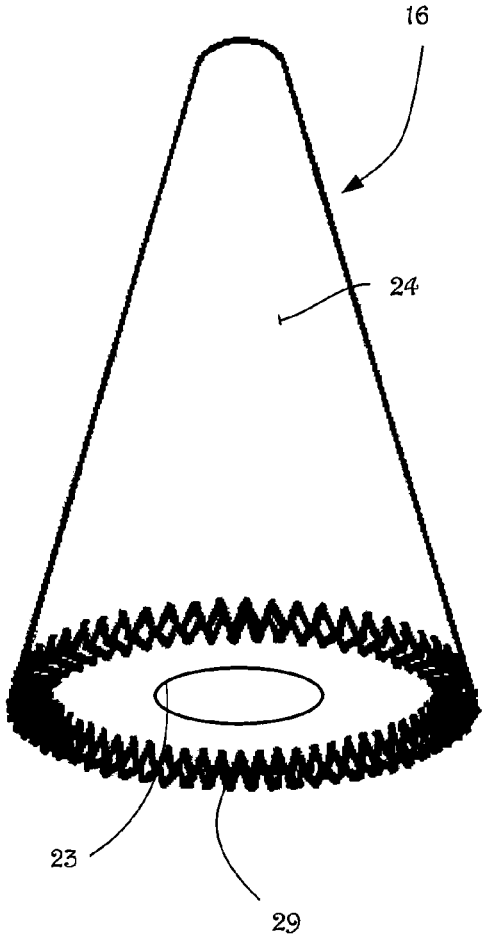
FIG. 3 is a perspective view of a locking housing of the item securing apparatus shown in FIG. 1.

The locking housing 16 is generally shown in FIGS. 1, 2 and 3. As illustrated in this embodiment, the locking housing 16 includes a body portion 24 of a generally solid conical configuration. The conical configuration may be truncated or substantially conical as shown in FIGS. 1, 2 and 3. As illustrated, the body portion 24 includes an upper portion having a first diameter and a base portion having a second diameter larger than the first diameter. The body portion 24 defines an opening 23 in the base portion thereof to receive the ground engaging member 18. The conical configuration hampers a thief's ability to grip the body portion 24 for forceful extraction from the ground engaging member 18 or the ground surface 14. The body portion 24 is formed of a substantially rigid material, such as plastic, thermoplastic, metal or another substantially rigid material. In one embodiment, certain brands or advertisements are adhered to or formed with the body portion 24, e.g., by adhesive, fasteners, bonding or molding. The locking housing 16 also includes a handle portion 26 which is fixedly secured to the body portion 24 in this embodiment, e.g., through a snap-fit arrangement. For example, as shown in FIG. 2, the handle portion 26 includes a flanged portion 28 at one end thereof that is received within a recess (not shown) of the body portion 24 to effect the snap-fit arrangement. The present disclosure contemplates other suitable arrangements. For example, the handle portion 26 may be integrally formed with the body portion 24 through molding, welding or another bonding process.

As illustrated in FIGS. 1, 2, and 3, a plurality of protrusions 29 extend annularly around the base of the body portion 24. Such protrusions are substantially sharp in one embodiment to deter a thief from trying to forcefully pull the locking housing 16 from the ground engaging member 18 or the ground surface 14. In another embodiment, the body portion 24 includes a motion detector (not shown) positioned within a recess (not shown) of the body portion 24. The motion detector is configured to detect tampering or motion of the locking housing 16. The motion detector increases theft deterrence by outputting audio signals, such as an alarm sound, or visual signals, such as flashing lights, if tampering or movement of the locking housing 16 is detected. Other indicators may be employed to alert a beachgoer or a commercial entity of such tampering or movement.

In alternative embodiments, the locking housing 16 can be formed into almost any design shape, such as a disk-shape, a sphere-shape, a rectangle-shape or any other shape, so long as the locking housing can adequately support one or more locking devices 20. Certain shapes may be better suited to hamper a thief's ability to grip the body portion 24 for forceful extraction from the ground engaging member 18 or the ground surface 14.

Figure 4:
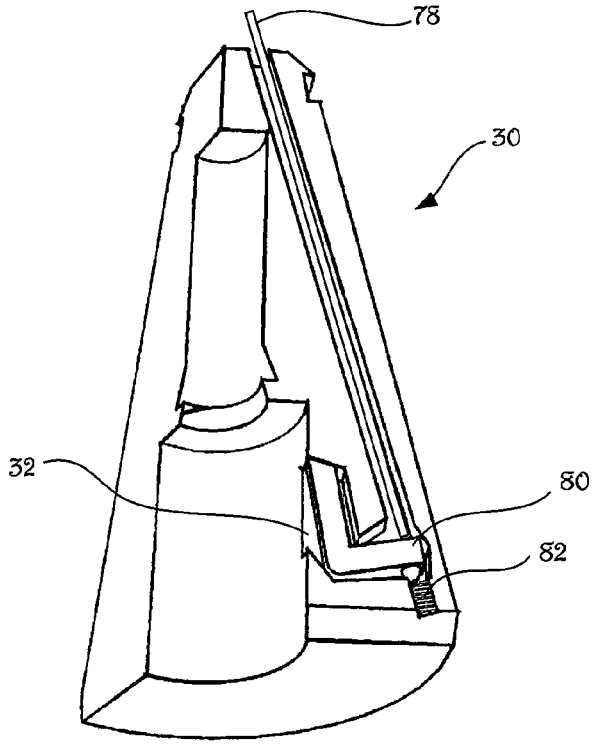
FIG. 4 is a sectional view of one embodiment of a locking housing of the item securing apparatus shown in FIG. 1.

In one alternative embodiment shown in FIG. 4, the locking housing 16 includes a plurality of molded components 30 that can be snapped together or fastened together with suitable fasteners. FIG. 4 illustrates one of three identical components 30 that, when assembled together within body portion 24 of the locking housing 16, form the interior of the locking housing 16. In one embodiment, the insert components 30 are formed, e.g., molded, to provide one or more voids or recesses 32 to support the locking device 20 or a plurality of the locking devices 20. In an alternative embodiment, the locking housing 16 defines a secure compartment that can be locked or unlocked with the locking device 20.

Figure 5:
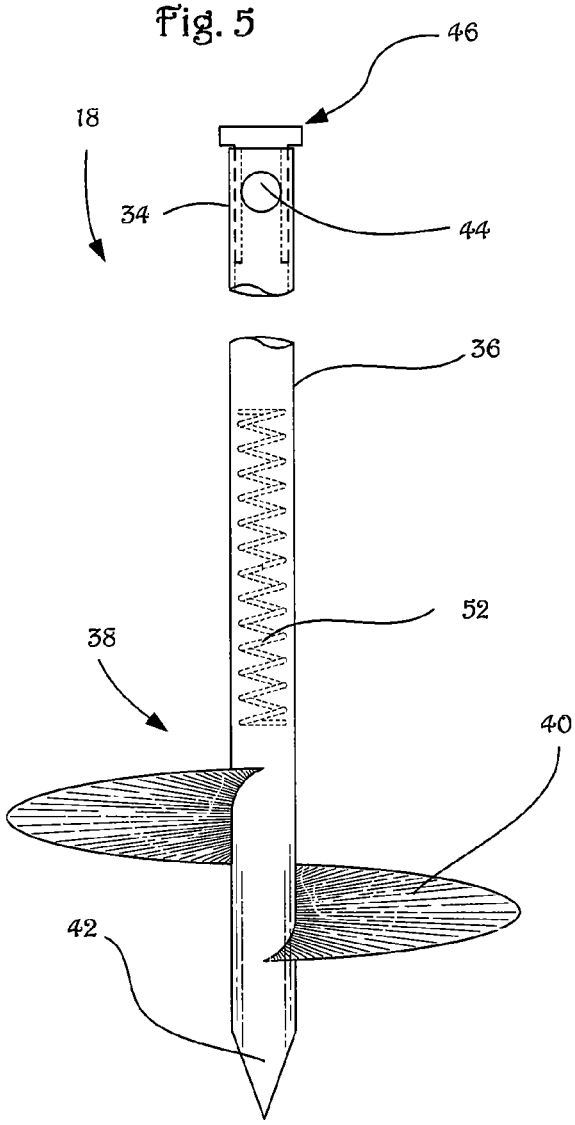
FIG. 5 is a side view of a ground engaging member of the item securing apparatus shown in FIG. 1.
Figure 6:
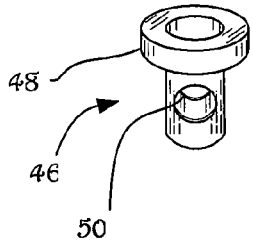
FIG. 6 is a perspective view of a removable insert employed in one embodiment of the ground engaging member.

FIG. 5 illustrates one embodiment of the ground engaging member 18. The ground engaging member 18 includes an elongated body portion 36 having first and second ends 34 and 38. The body portion 38 is a tubular sleeve or receiver in this embodiment that is configured to telescopically receive the handle portion 26. A ground engaging or penetrating structure 40, such as an auger blade, is attached to the second end 38 of the body 36. The second end 38 includes a pointed tip portion 42 to facilitate insertion or penetration into the ground surface 14. The ground engaging member 18 defines an opening 44 through the first end 34 of the body portion 38. The opening 44 is configured to receive the handle portion 26 in embodiments where the handle portion 26 is used as a turning or torque lever for the ground penetrating structure 40. In one embodiment, the ground engaging member 18 is strengthened at the opening 44 by a removable insert or bushing 46 (FIG. 6). The bushing 46 includes a flanged portion 48 that extends annularly beyond a diameter of the body portion 38. The busing 46 also includes an opening 50 which aligns with the opening 44 of the ground engaging member 18 when the bushing 46 is inserted into the first end 34 of the ground engaging member 18. In another embodiment, the bushing 46 and the first end 34 of the ground engaging member 18 are integrally formed.

As illustrated in FIG. 5, a biasing member 52, such as a spring, is positioned inside the body portion 36 of the ground engaging member 18. The biasing member 52 engages the handle portion 26 in embodiments where the handle portion 26 is inserted or telescopically received in the ground engaging member 18 and aids in the removal of the handle portion 26 from the ground engaging member 18 as will be described in further detail below.

Referring back to FIG. 1, the handle portion 26 is engageable with the ground engaging member 18 as a turning or torque lever for the ground penetrating structure 40. Rotational movement of the handle portion 26 (about the ground engaging member 18) drives the ground penetrating structure 40 and the pointed tip 42 of the ground engaging member 18 into the ground surface 14. Once the ground penetrating structure 40 and the pointed tip 42 penetrates the ground surface 14 at the appropriate depth, the handle portion 26 is removed from the aligned holes 44 and 50 in the ground engaging member 18 and the bushing 46, respectively.

With the ground engaging member 18 positioned in the ground surface 14, one or a plurality of item security mechanisms 22 are positioned on or otherwise suitably attached to the handle portion 26 or the ground engaging member 18. In one embodiment, the item securing mechanism 22 includes a securing member 53 having an opening extending therethrough (FIG. 2). The securing member 53 is configured to receive the handle portion 26 or the body portion 38 of the ground engaging member 18 through the opening defined therein. The opening in the securing member 53 has a diameter of smaller size than the diameter of the base portion of the locking housing 16 for theft deterrent purposes, e.g., to prevent removal over the body portion 24 of the locking housing 16.

In one embodiment, the securing member 53 is configured to be fixedly secured, e.g., welded, adhered or fastened, to a securing element 54 or a securing receptacle 56. As illustrated in FIG. 2, the securing member 53 is fixedly secured to the securing element 54. The securing element 54, such as a cable, chain or another substantially strong and flexible securing member, is attachable to the item 12. In another embodiment, the securing element 54 includes a retractable cable positioned inside the body portion 24 of the locking housing 16. The securing receptacle 56, such as a bag or container, is configured to store an item, such as item 12, therein.

In one embodiment, the securing element 54 and/or the securing receptacle 56 is placed on the handle portion 26 and transferred to the ground engaging member 18 when the handle portion 26 is substantially sheathed inside the body portion 36 of the ground engaging member 18 as described below. In another embodiment, the securing element 54 and/or the securing receptacle 56 are positioned over the first end 34 of the ground engaging member 18 (and the bushing 46 if provided). In this manner, the securing element 54 and/or the securing receptacle 56 is operatively secured to the ground engaging member 18 when the handle portion 26 is substantially sheathed inside the body portion 36 of the ground engaging member 18.

In one embodiment, each item securing mechanism 22 is positioned in movable relationship with the ground engaging member 18 between the ground surface 14 and the locking housing 16. In another embodiment, one of the item securing mechanisms 22 is fixed relative to the ground engaging member 18 between the ground surface 14 and the locking housing 16.

Figure 7:
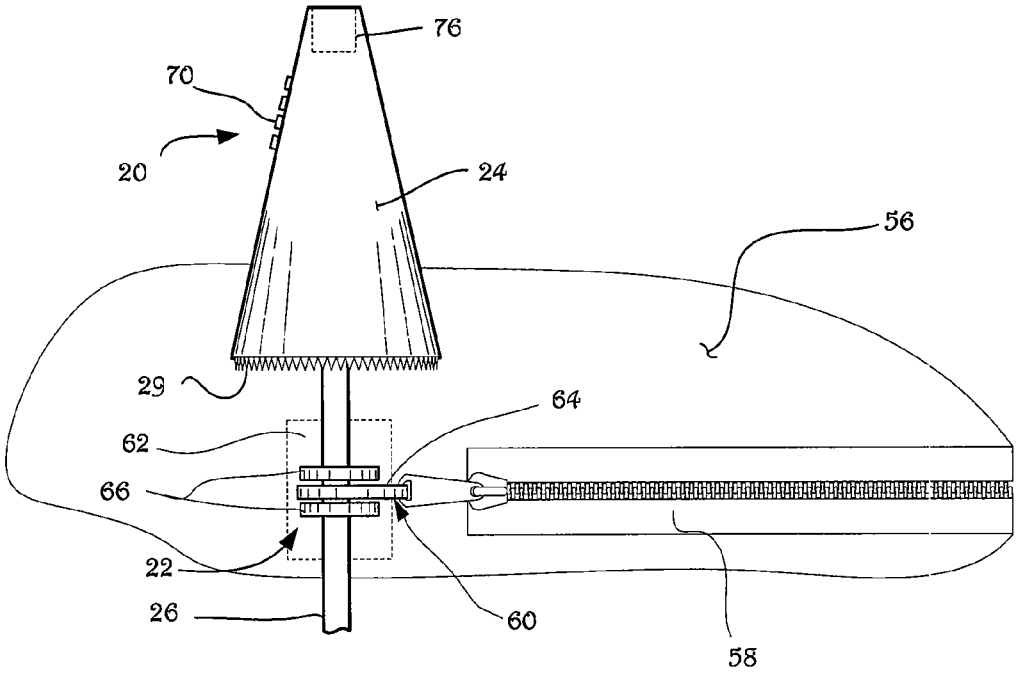
FIG. 7 is a side view of the locking housing shown in FIG. 4 engaged with a securing receptacle.

FIG. 7 shows the securing receptacle 56 in greater detail. In this embodiment, the securing receptacle 56 includes a security bag or container that is configured to store one or a plurality of items 12. The securing receptacle 56 is made of a high-strength and tear resistant fabric or material, such as nylon. The high-strength and tear resistant fabric or material is configured to prevent thieves from cutting the security bag open with a knife or other such instrument. In this embodiment, the securing receptacle 56 includes a fastener 58, in the form of a zipper, that interfaces with a hasp 60. The hasp 60 is one form of the securing member 53 described above. The hasp 60 is mounted to a rigid insert 62 which is effectively sewn or attached to the securing receptacle 56 in another manner. In another embodiment, one of the washer-type rings 66 is fixedly secured, e.g., welded, adhered or fastened, to the rigid insert 62 of the securing receptacle 56.

Figure 8:
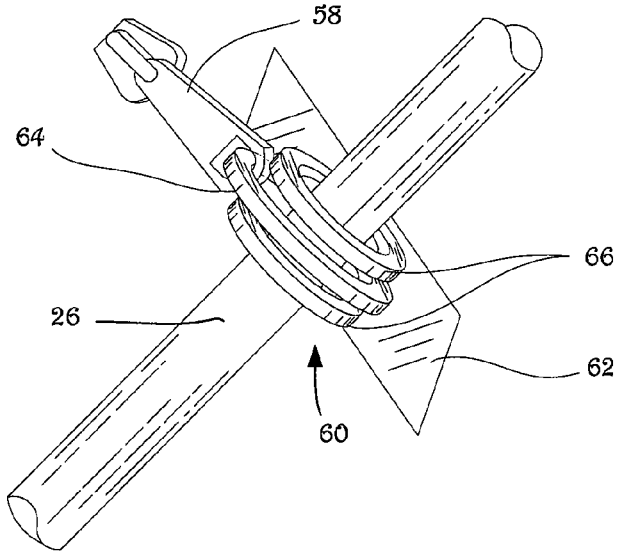
FIG. 8 is perspective view of a hasp employed in one embodiment of the securing receptacle.

As illustrated in FIGS. 7 and 8, the hasp 60 includes a washer-type latching mechanism 64 positioned between substantially adjacent to parallel washer-type rings 66. The latching mechanism 64 is configured to attach to the end of the fastener 58 to secure the securing receptacle in the closed position. The latching mechanism 64 and the washer-type rings 66 cooperate to define an opening through the hasp 60, which is configured to receive the handle portion 26 or the body 38 of the ground engaging member 18. As illustrated, the hasp 60 is positioned on the handle portion 26 so that the handle portion extends through the opening defined by the hasp 60. In this embodiment, the hasp 60 is transferred from the handle portion 26 to the ground engaging member 18 when the handle portion 26 is substantially sheathed inside the body portion 36 of the ground engaging member 18. In another embodiment, the hasp 60 is positioned on the body 38 of the ground engaging member 18. The hasp 60 and the securing receptacle 56 constitute an item securing mechanism 22 that operatively secures any items 12 stored in the securing receptacle 56 to the ground engaging member 18.

FIGS. 9, 9*a*, 9*b* and 9*c* illustrate one embodiment of the locking device 20 in greater detail. The locking device 20 is positioned in the body portion 24 of the locking housing 16. In this embodiment, the locking device 20 includes a conventional rotation combination lock having a locking member 68, alphanumeric symbols 70 and a biasing member 72, such as a spring. The symbols 70 are accessible to an exterior of the locking housing 16. The locking member 68 is movable between a locked position and an unlocked position. In the locked position, the locking member 68 is biased by biasing member 72 through the combination lock. In the unlocked position, when the correct code or combination is set via symbols 70, the locking member 68 is configured to retract through the combination lock against the bias of the biasing member 72. The biasing member 72 mitigates the retraction of the locking member 68 when the correct code or combination is set. The locking device 20 also includes a locking mechanism 74 in this embodiment, which cooperates with the locking member 68 to move between locked and unlocked positions when the locking device 20 is moved to respective locked and unlocked positions.

In other embodiments, the locking member 68 includes a keyed lock, an electronic lock, a mechanical digital lock or any other lock desired by the device implementer. The locking member 68 of these embodiments may or may not be conventional and may include any alphanumeric symbols to lock and unlock the device 20.

Figure 9:
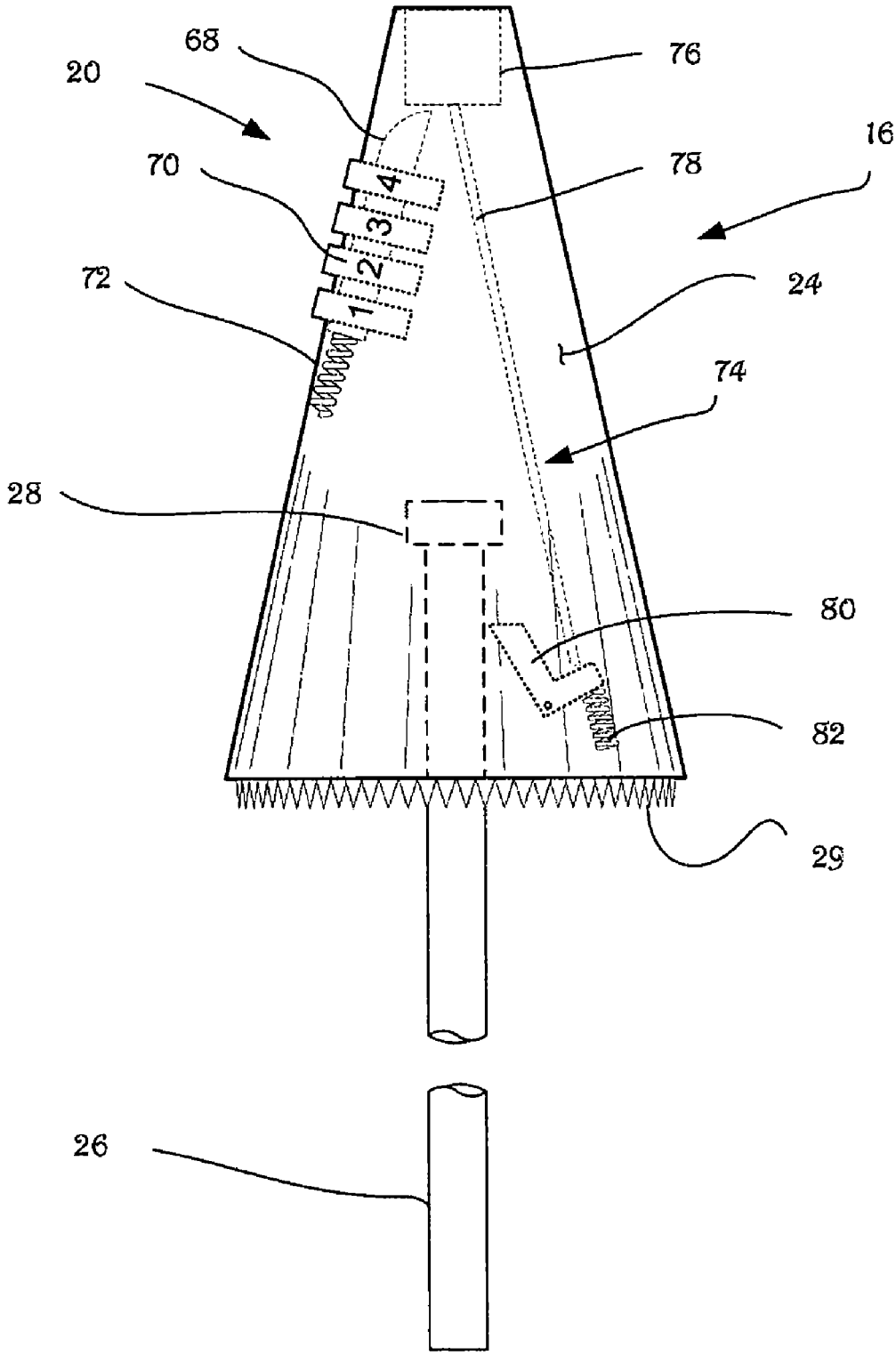
FIG. 9 is side view of the locking housing with certain portions removed to show internal components in more detail.

As shown in FIG. 9, the locking mechanism 74 includes a lock release member or a release button 76, a movement transfer member 78, a lock activator member 80 and a biasing member 84. The lock release member 76 engages the locking member 68. As illustrated, the release button 76 is recessed for theft deterrent purposes into the body portion 24 of the locking housing 16. The movement transfer member 78 is configured to engage the lock release member 76 at a first end thereof and is configured to engage a lock activator member 80 at a second end thereof. Lock activator member 80 is generally L-shaped and pivots about pivot axis 82. The biasing member 84, such as a spring, is configured to bias the lock activator member 80 against the movement transfer member 78 toward a locked position thereof as shown in FIG. 9.

Figure 9A:
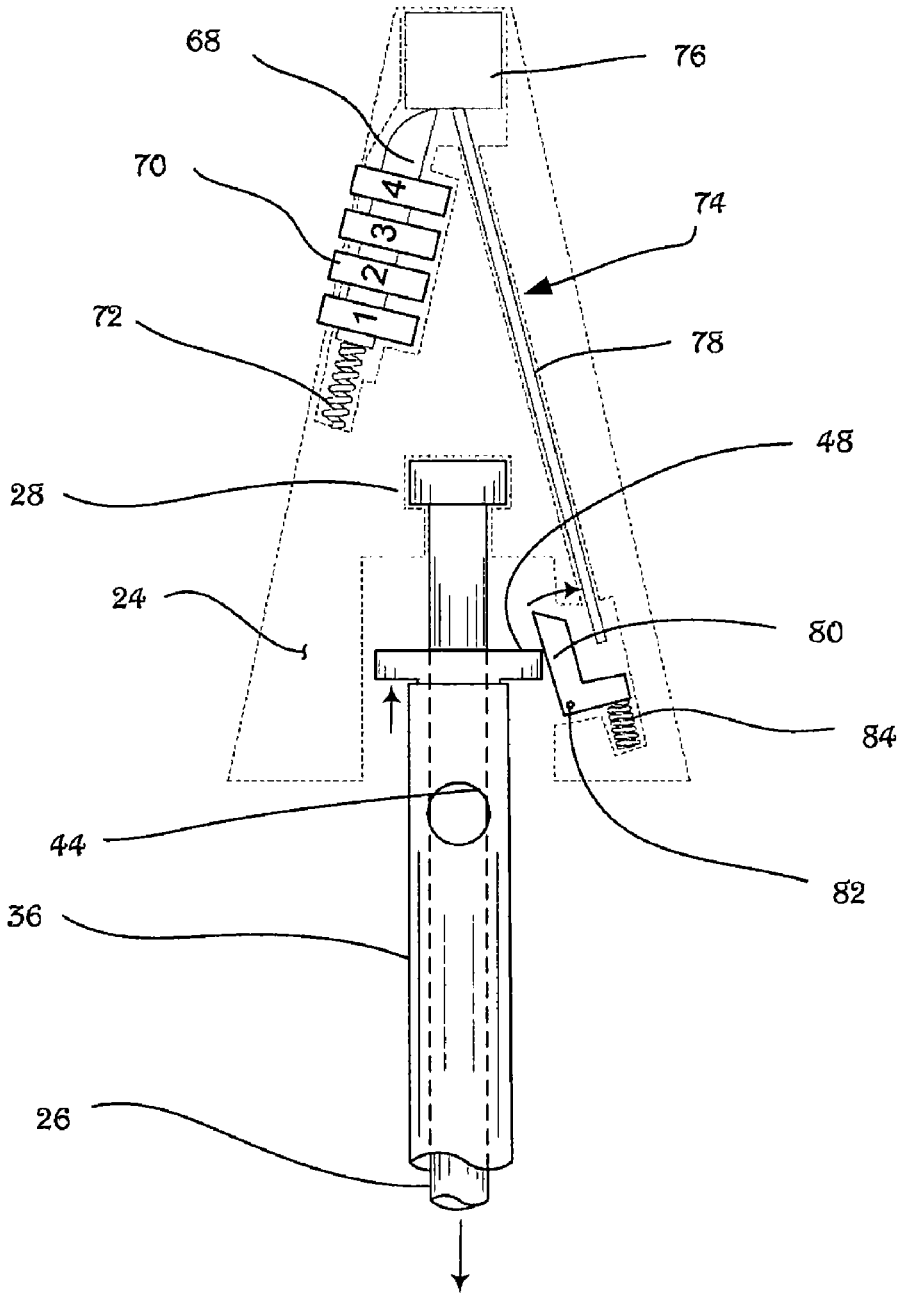
FIG. 9*a* is a side view of the locking housing with certain portions removed to show internal components in more detail, wherein a handle portion is partially inserted into a ground engaging member.
Figure 9B:
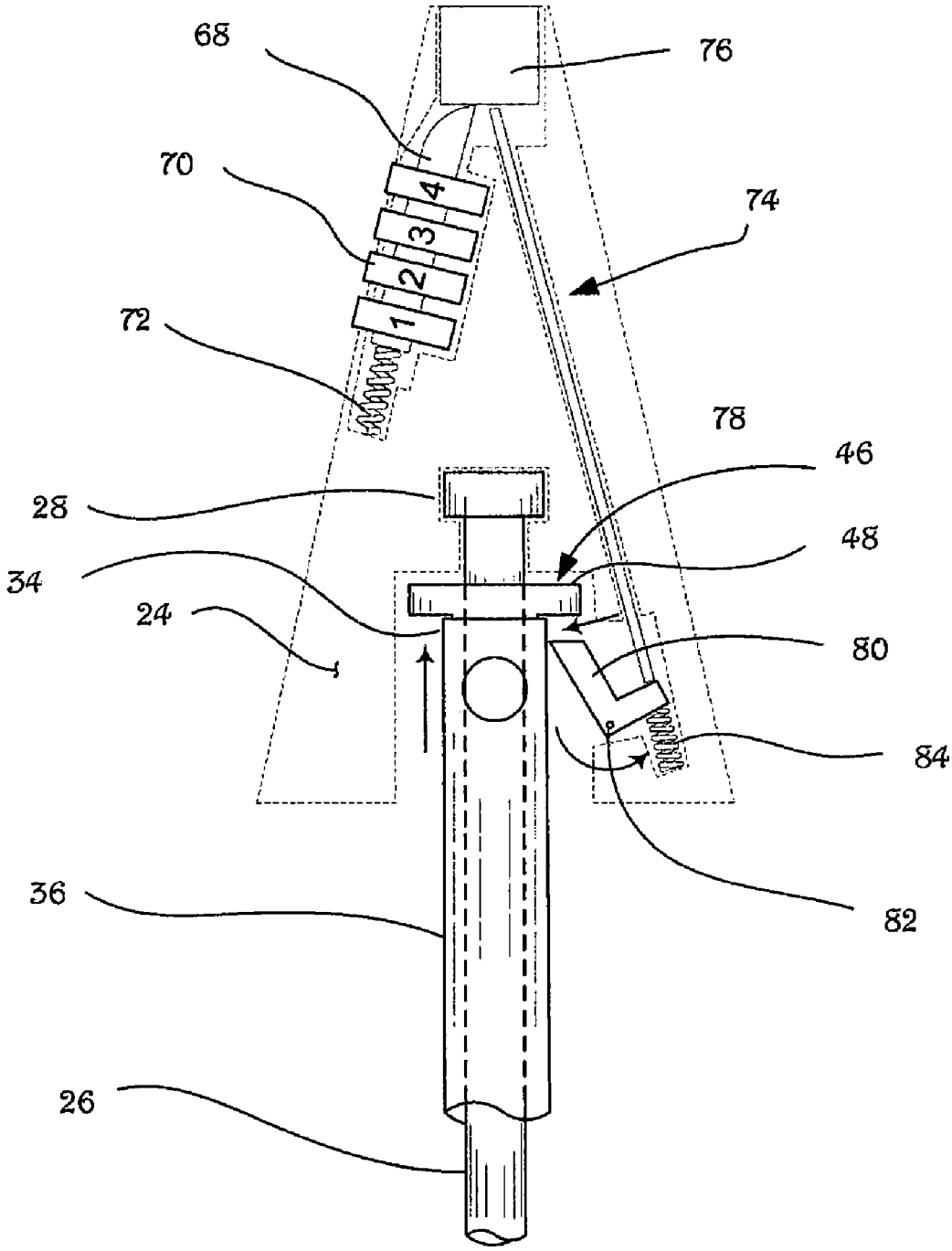
FIG. 9*b* is a side view of the locking housing with certain portions removed to show internal components in more detail, wherein the handle portion is fully inserted into the ground engaging member and a locking device is in a locked position.
Figure 9C:
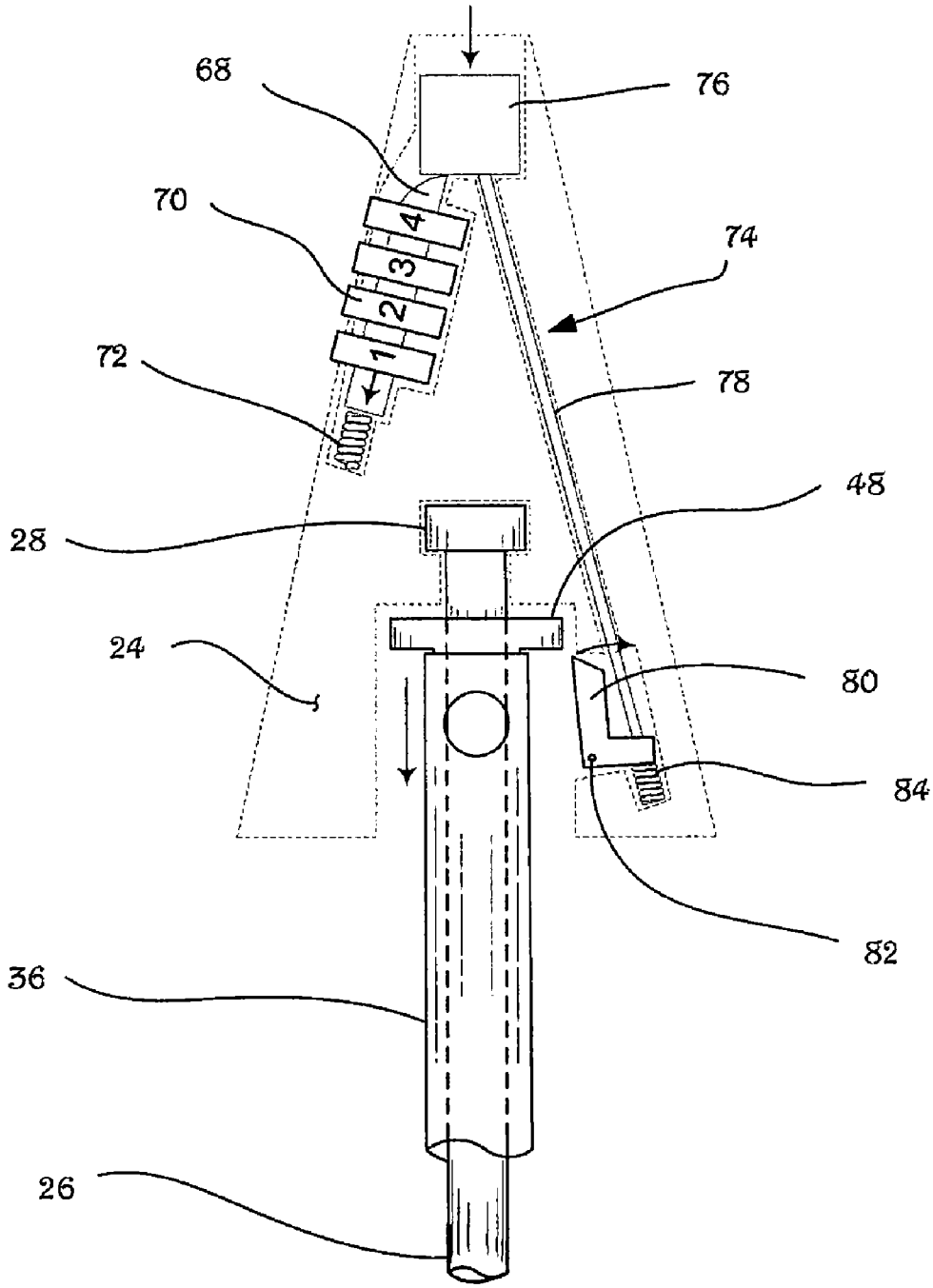
FIG. 9*c* is a side view of the locking housing with certain portions removed to show internal components in more detail, wherein the handle portion is fully inserted into the ground engaging member and a locking device is in an unlocked position.

The locking member 68 is configured to engage the release button 76 of the locking mechanism 74 when the locking device 20 is moved to the locked position as shown in FIGS. 9 and 9*b*. The locking member 68 is configured to disengage the release button 76 of the locking mechanism 74 when the locking device 20 is moved to the unlocked position as shown in FIG. 9*c*.

FIG. 9*a* illustrates the insertion of the handle portion 26 into the ground engaging member 18 as described above. The ground engaging member 18 telescopically receives the handle portion 26 therein. As shown, the locking device 20 is initially positioned in the locked position, wherein locking member 68 is engaged with release button 76. Movement of the locking housing 16 toward the ground engaging member 18 causes the flanged portion 48 of the bushing 46 (on the first end 34 of the ground engaging member 18) to engage the lock activator member 80. This engagement moves the lock activator member 80 against the bias of biasing member 84 and out of its locked position about pivot axis 82. Biasing member 84 biases the lock activator member 80 against the flanged portion 48 of the bushing 46 (on the first end 34 of the ground engaging member 18) and the body 36 of the ground engaging member 18 during the insertion of the handle portion 26 into the ground engaging member 18.

FIG. 9*b* illustrates the handle portion 26 substantially sheathed inside the body portion 36 of the ground engaging member 18. The locking member 68 and the locking mechanism 74 are illustrated in the locked position. In the locked position, the biasing member 84 biases the lock activator member 80 against the ground engaging member 18 adjacent to the flanged portion 48 of the bushing 46 (on the first end 34 of the ground engaging member 18). The lock activator member 80 locks the handle portion 26 into the ground engaging member 18 via engagement with the flanged portion 48 of the bushing 46 as shown in FIG. 9*b*. In this locked position, the locking member 68 and the locking mechanism 74 effectively lock the locking housing 16 to the ground engaging member 18 and operatively secure the one or more item securing members 22 to the ground surface 14.

Once in the locked position shown in FIG. 9*b*, the handle portion 26 is configured to rotate freely relative to and within body 38 of the ground engaging member 18. During the free rotation, the handle portion 26 does not engage the ground penetrating structure 40 and remains locked to the ground engaging member 18. Additionally, in one embodiment, the aligned openings 44 and 50 of the ground engaging member 18 and the bushing 46, respectively, are positioned inside the body portion 24 of the locking housing 16 and are inaccessible unless the handle portion 26 is at least partially removed from the ground engaging member 18. In another embodiment, the aligned openings 44 and 50 of the ground engaging member 18 and the bushing 46, respectively, are positioned outside the body portion 24 of the locking housing 16 and are substantially or completely blocked when the handle portion 26 is sheathed inside the body portion 36 of the ground engaging member 18.

FIG. 9*c* illustrates the locking device 20 in an unlocked position. To access this unlocked position, the symbols 70 on the combination locking device 20 must be set to the correct combination or code which will, in turn, allow the retraction of the lock member 68 against the bias of spring 72. The retraction of the locking member 68, mitigated by spring 72, enables depression of the lock release member 76. When the release button 76 is depressed, the release button 76 engages movement transfer member 78. This engagement causes the movement transfer member 78 to move the lock activator member 80 about pivot axis 82. Once the lock activator member 80 is moved beyond the flanged portion 48 of the bushing 46 (on the first end 34 of the ground engaging member 18), the biasing member 52 within the body portion 36 of the ground engaging member 18 biases the handle portion 26 away from the ground penetrating structure 40 and the pointed tip 42 and out of the ground engaging member 18.

After the handle portion 26 is removed from the ground engaging member 18, the handle portion 26 is employed to remove the ground engaging member 18 from the ground surface 14 as shown in FIG. 1. To effect removal, the handle portion 26 is reinserted into the aligned openings 44 and 50 in the ground engaging member 18 and the bushing 46, respectively, and rotated in the manner described above.

In one alternative embodiment, the locking member 68 is integrated with movement transfer member 78. In this embodiment, the movement transfer member 78 replaces the locking member 68 and is movable between locked and unlocked positions during the operation of the locking device 20. In the locked position, the locking device 20 inhibits the movement transfer member 78 from moving the lock activator member 80 against the bias of biasing member 84. In the unlocked position, the locking device 20 allows the movement transfer member 78 to move freely therethrough. The movement transfer member 78 moves the lock activator member 80 against the bias of biasing member 84, which moves the lock activator member 80 into its unlocked position. The biasing member 84 mitigates the movement of the movement transfer member 78 when the correct code or combination is set via symbols 70.

In one embodiment, the ground engaging member 18 and any item securing mechanisms 22 are configured for transportation or portability inside the securing receptacle 56. Once the ground engaging member 18 and any item securing mechanisms 22 are positioned inside the securing receptacle 56, the handle portion 26 of the locking housing 16 cooperates with the securing receptacle 56 to transport the ground engaging member 18 and any item securing mechanisms 22 from location to location by acting as a handle. In another embodiment, the handle portion 26 is positioned to extend through openings formed in or attached to the securing receptacle 56 to act as a handle for the securing receptacle 56, the ground engaging member 18 and any item securing mechanisms 22.

Figure 10:
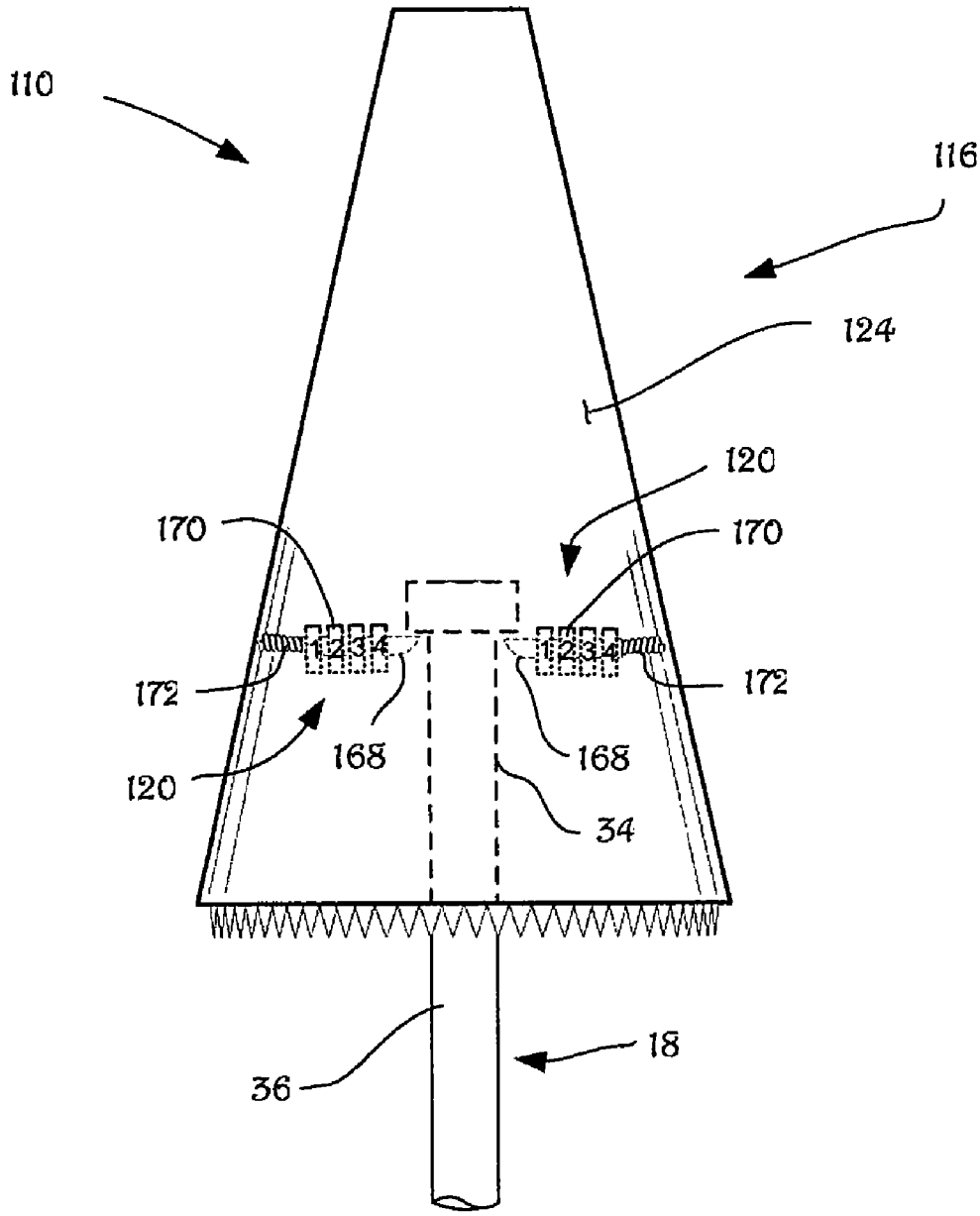
FIG. 10 is a side view of an alternate embodiment of an item securing device.

FIG. 10 illustrates an item securing apparatus 110, which is an alternative embodiment of the item securing apparatus 10. The device 110 is substantially similar to the device 10, but includes a plurality of locking devices 120 positioned in a locking housing 116. The locking devices 120 removably attach the locking housing 116 to the ground engaging member 18 described above. In this embodiment, the locking housing 116 is substantially the same as the locking housing 16 described above. Although not shown, the locking housing 116 includes a handle portion similar to the handle portion of locking housing 16. In another embodiment, the locking housing 116 differs from the locking housing 16 and may or may not include a handle portion.

In this example, the device 110 includes a plurality of locking devices 120 positioned in a body portion 124 of the locking housing 116. The body portion 124 is fixedly secured to a handle portion (not shown) of the locking housing 116. Each locking device 120 includes a conventional rotation combination lock having a locking member 168, alphanumeric symbols 170 and a spring 172. Each of the locking devices 120 operate in the same manner in this embodiment although it is contemplated that one or more of the plurality of locking devices 120 may be implemented different locking devices.

The symbols 170 of locking device 120 are accessible to an exterior of the locking housing 116. The locking member 168 is movable between a locked position and an unlocked position. In the locked position, the locking member 168 is biased by spring 172 through the combination lock to engage the flanged portion 48 of the bushing 46 (on the first end 34 of the ground engaging member 18). In the unlocked position, the locking member 168 is configured to retract through the combination lock against the bias of the spring 172 to disengage the flanged portion 48 of the bushing 46 (on the first end 34 of the ground engaging member 18). The spring 172 mitigates the retraction of the locking member 168 when the correct code or combination is set via symbols 170. In alternative embodiments, the locking device 120 includes a keyed lock, an electronic lock, a mechanical digital lock or any other lock desired by the device implementer.

In an alternative embodiment, the device 110 is configured to support an umbrella using a plurality of the locking devices 120. In this embodiment, an umbrella handle portion is secured and locked into the locking housing 116 in the same manner as the ground engaging member 18. For example, a plurality of locking devices 120 engages a flanged portion of the umbrella handle portion. As described above, in the locked position, the locking member 168 of each locking device 120 is biased by spring 172 through the combination lock to engage the flanged portion of the umbrella handle portion (similar to the flanged portion 48 of bushing 46 described above). In the unlocked position, the locking member 168 is configured to retract through the combination lock against the bias of the spring 172 to disengage the flanged portion of the umbrella handle portion (similar to the flanged portion 48 of bushing 46 described above). In one embodiment, the locking housing 116 defines an opening in an upper portion of the body portion 124 to receive the umbrella handle portion into the locking housing 116.

With respect to the preferred embodiment described above, it must be noted that the ideal dimensions of each component, both individually and as they relate to each other, are subject to include variations in size, materials function, form, and shape as deemed readily apparent to one skilled in the art. Thus, any appropriate modifications that will occur for manufacturing, utility or design purposes are intended to be encompassed by the present invention.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An item securing apparatus operative to secure at least one item to a ground surface, the item securing apparatus comprising:

a locking housing having a body portion and a handle portion extending from said body portion;

a ground engaging member including a body portion having a bottom end having a ground penetrating structure insertable into the ground surface and a top end opposite the bottom end, said body portion of the ground engaging member configured to telescopically receive the handle portion of the locking housing;

a locking device positioned in the locking housing, the locking device movable between a locked position and an unlocked position, said locking device configured to (1) engage the top end of the ground engaging member to lock the locking housing to the top end of the ground engaging member in the locked position, and (2) disengage the top end of the ground engaging member to unlock the locking housing from the top end of the ground engaging member in the unlocked position; and at least one item securing mechanism having a first end thereof engageable with the body portion of the ground engaging member and having a second end thereof engageable with the at least one item to operatively secure the at least one item to the body portion of the ground engaging member.

2. The item securing apparatus of claim 1, wherein the at least one item securing mechanism includes a securing member having an opening extending therethrough and wherein the body portion of the ground engaging member is configured to extend through the opening in the securing member to secure the at least one item securing mechanism thereto.

3. The item securing apparatus of claim 2, wherein the securing member is attached to at least one of a securing receptacle and a securing element.

4. The item securing apparatus of claim 3, wherein the securing receptacle includes a bag configured to store the item therein.

5. The item securing apparatus of claim 3, wherein the securing element includes a substantially strong and flexible material configured to attach to the item.

6. The item securing apparatus of claim 1, wherein the top end of the ground engaging member includes a flanged surface and wherein the locking device includes a locking member operable to engage the flanged surface of the ground engaging member when the locking device is moved into the locked position thereof.

7. The item securing apparatus of claim 1, wherein the body portion of the ground engaging member defines at least one transversely extending opening therein, wherein prior to telescopically inserting the handle portion of the locking housing into the body portion of the around engaging member, the handle portion of the locking housing can be inserted through the at least one opening such that movement of the handle portion causes the ground engaging member to rotate.

8. The item securing apparatus of claim 7, wherein the body portion of the locking housing has a substantially conical configuration, the conical configuration including an upper portion having a first diameter and a base portion having a second diameter larger than the first diameter.

9. The item securing apparatus of claim 8, wherein the securing member defines an opening therein, the opening having a diameter of smaller size than the diameter of the base portion of the conical configuration.

10. The item securing apparatus of claim 1, wherein the locking device includes a locking member and at least one locking mechanism movable between locked and unlocked positions when the locking device is moved to respective locked and unlocked positions, wherein the locking member is configured to engage the locking mechanism when the locking device is moved to the locked position and wherein the locking member is configured to disengage the locking mechanism when the locking device is moved to the unlocked position.

11. The item securing apparatus of claim 10, wherein the locking mechanism includes a lock release member and at least one lock activator member positioned in the body portion of the locking housing, at least one movement transfer member configured to engage the lock release member at a first end thereof and configured to engage the lock activator member at a second end thereof and at least one biasing member configured to bias the lock activator member against the movement transfer member toward a locked position thereof.

12. The item securing apparatus of claim 1, wherein the body portion of the ground engaging member is substantially tubular and configured to telescopically receive the handle portion of the locking housing so that the locking housing is freely rotatable relative to the ground engaging member.

13. The item securing apparatus of claim 12, which includes a biasing member positioned in the body portion of the ground engaging member, wherein the biasing member is configured to bias the handle portion of the locking housing away from the ground penetrating structure when the handle portion of the locking housing is telescopically received by the body portion of the ground engaging member.

14. The item securing apparatus of claim 1, wherein the body portion of the locking housing includes a retractable coiled cable configured to attach to at least one of a securing receptacle and the at least one item.

15. An item securing apparatus operative to secure at least one item to a ground surface, the item securing apparatus comprising:

a locking housing having a body portion and a handle portion;

a ground engaging member including tubular body having a bottom end insertable into the ground surface and a top end configured to be engaged by the body portion of the locking housing, wherein the tubular body is configured to telescopically receive the handle portion of the locking housing so that the handle portion is freely rotatable relative to the tubular body;

a locking device positioned in the body portion of the locking housing and movable between a locked position and an unlocked position, said locking device configured to move from the unlocked position to the locked position when the handle portion of the locking housing is telescopically received in the tubular body of the ground engaging member, said locking device configured to (1) engage the top end of the ground engaging member to lock the locking housing to the top end of the ground engaging member in the locked position, and (2) disengage the top end of the ground engaging member to unlock the locking housing from the end of the ground engaging member in the unlocked position; and at least one item securing mechanism engageable with the tubular body of the ground engaging member at one end thereof and engageable with the at least one item at another end thereof.

16. The item securing apparatus of claim 15, wherein the locking device is positioned into the locked position thereof prior to the handle portion of the locking housing being telescopically received in the tubular body of the ground engaging member.

17. The item securing apparatus of claim 15, wherein the locking device includes a locking member and a locking mechanism movable between locked and unlocked positions when the locking device is moved to respective locked and unlocked positions, said locking member configured to engage the locking mechanism when the locking device is moved to the locked position and wherein the locking member is configured to disengage the locking mechanism when the locking device is moved to the unlocked position.

18. The item securing apparatus of claim 17, wherein the locking mechanism includes a lock release member and a lock activator member positioned in the body portion of the locking housing, a movement transfer member configured to engage the lock release member at a first end thereof and configured to engage the lock activator member at a second end thereof and a biasing member configured to bias the lock activator member against the movement transfer member toward a locked position thereof.

19. The item securing apparatus of claim 18, wherein when the locking member is positioned in the unlocked position, the lock release member is configured to move from a locked position to an unlocked position and movement of the lock release member into the unlocked position thereof applies a force to the movement transfer member to move the lock activator member into an unlocked position thereof from the locked position thereof.

20. The item securing apparatus of claim 19, wherein when the locking member moves into the locked position, the locking member is configured to engage the lock release member to move the lock release member into the locked position thereof.

21. The item securing apparatus of claim 20, wherein the movement transfer member is configured to move away from the lock activator member when the lock release member is moved into the locked position thereof and wherein the biasing member is configured to bias the lock activator member into the locked position thereof.

22. A method of securing at least one item to a ground surface, the method comprising:

providing a locking housing having a body portion and a handle portion;

providing a ground engaging member including a tubular body having a bottom end insertable into the ground surface and a top end configured to removably receive the handle portion of the locking housing;

providing at least one item securing mechanism engageable with the tubular body of the ground engaging member at one end thereof and engageable with the at least one item at another end thereof;

enabling the tubular body of the ground engaging member to telescopically receive the handle portion of the locking housing therein such that the handle portion is freely rotatable relative to the tubular body; and providing a locking device positioned in the body portion of the locking housing and movable between a locked position and an unlocked position, said locking device configured to move from the unlocked position to the locked position when the handle portion of the locking housing is telescopically received in the tubular body of the ground engaging member, said locking device configured to (1) engage the top end of the ground engaging member to lock the locking housing to the top end of the ground engaging member in the locked positions, and (2) disengage the top end of the ground engaging member to unlock the locking housing from the top end of the ground engaging member in the unlocked position.

23. The method of claim 22, which includes enabling the handle portion to engage the ground engaging member to apply a rotational force to the ground engaging member to effect insertion of the ground engaging member into the ground surface.

24. An item securing apparatus operative to secure at least one item to a ground surface, the item securing apparatus comprising:

a locking housing having a body portion and a handle portion extending from said body portion;

a ground engaging member including a substantially tubular body portion having a bottom end insertable into the ground surface and a top end opposite the bottom end, said bottom end including a ground penetrating structure attached configured to penetrate the ground surface upon application of a predetermined rotational force to the body portion of the ground engaging member, said substantially tubular body portion configured to telescopically receive the handle portion extending from said body portion of the locking housing so that the locking housing is freely rotatable relative to the ground engaging member;

a biasing member positioned in the substantially tubular body portion of the ground engaging member, said biasing member configured to bias the handle portion of the locking housing away from the ground penetrating structure when the handle portion of the locking housing is telescopically received by the substantially tubular body portion of the ground engaging member;

a locking device positioned in the locking housing, the locking device movable between a locked position and an unlocked position, said locking device configured to (1) engage the top end of the ground engaging member to lock the locking housing to the top end of the ground engaging member in the locked position, and (2) disengage the top end of the ground engaging member to unlock the locking housing from the top end of the ground engaging member in the unlocked position; and at least one item securing mechanism having a first end thereof engageable with the body portion of the ground engaging member and having a second end thereof engageable with the at least one item to operatively secure the at least one item to the body portion of the ground engaging member.

25. The item securing apparatus of claim 24, wherein the at least one item securing mechanism includes a securing member having an opening extending therethrough and wherein the body portion of the ground engaging member is configured to extend through the opening in the securing member to secure the at least one item securing mechanism thereto.

26. The item securing apparatus of claim 24, wherein the substantially tubular body portion of the ground engaging member defines at least one transversely extending opening therein, wherein prior to being telescopically inserted into the substantially tubular body portion of the ground engaging member, the handle portion of the locking housing can be inserted through the at least one opening so that the handle portion can be moved to cause the ground engaging member to rotate.

27. An item securing apparatus operative to secure at least one item to a ground surface, the item securing apparatus comprising:

a locking housing;

a ground engaging member including a body portion having a bottom end insertable into the ground surface and a top end opposite the bottom end;

a locking device positioned in the locking housing, the locking device movable between a locked position and an unlocked position, said locking device configured to (1) engage the top end of the ground engaging member to lock the locking housing to the top end of the ground engaging member in the locked position, and (2) disengage the top end of the ground engaging member to unlock the locking housing from the top end of the ground engaging member in the unlocked position, and wherein the body portion of the locking housing defines a secure compartment that can be locked or unlocked with the locking device; and at least one item securing mechanism having a first end thereof engageable with the body portion of the ground engaging member and having a second end thereof engageable with the at least one item to operatively secure the at least one item to the body portion of the ground engaging member.

28. The item securing apparatus of claim 27, wherein the locking device includes a locking member and at least one locking mechanism movable between locked and unlocked positions when the locking device is moved to respective locked and unlocked positions, wherein the locking member is configured to engage the locking mechanism when the locking device is moved to the locked position and wherein the locking member is configured to disengage the locking mechanism when the locking device is moved to the unlocked position.

29. The item securing apparatus of claim 28, wherein the at least one locking mechanism includes a lock release member and at least one lock activator member positioned in the body portion of the locking housing, at least one movement transfer member configured to engage the lock release member at a first end thereof and configured to engage the lock activator member at a second end thereof and at least one biasing member configured to bias the lock activator member against the movement transfer member toward a locked position thereof.

* * * * *